US011572145B1

(12) United States Patent
Andrasko et al.

(10) Patent No.: US 11,572,145 B1
(45) Date of Patent: Feb. 7, 2023

(54) TOP-DOWN SERVICEABLE OUTBOARD MOTORS

(71) Applicant: Brunswick Corporation, Mettawa, IL (US)

(72) Inventors: Steven J. Andrasko, Oshkosh, WI (US); Stephen R. Collins, Fond du Lac, WI (US); Mark W. Henker, Fond du Lac, WI (US); Matthew W. Jaeger, Oshkosh, WI (US); Wade A. Loberger, Oshkosh, WI (US); John I. S. Park, Fond du Lac, WI (US); Brad J. VanRuiswyk, Waupun, WI (US)

(73) Assignee: Brunswick Corporation, Mettawa, IL (US)

( * ) Notice: Subject to any disclaimer, the term of this patent is extended or adjusted under 35 U.S.C. 154(b) by 1 day.

(21) Appl. No.: 17/171,600

(22) Filed: Feb. 9, 2021

(51) Int. Cl.
*B63H 20/32* (2006.01)
*B63H 20/00* (2006.01)
*B63H 20/12* (2006.01)

(52) U.S. Cl.
CPC ..... *B63H 20/32* (2013.01); *B63H 20/002* (2013.01); *B63H 20/12* (2013.01); *B63H 2020/323* (2013.01)

(58) Field of Classification Search
CPC ..... B63H 20/32; B63H 20/002; B63H 20/12; B63H 2020/323
See application file for complete search history.

(56) References Cited

U.S. PATENT DOCUMENTS 4,661,076 A * 4/1987 Iwai ..... B63H 20/002 123/195 P
5,505,643 A * 4/1996 Prasse ..... F01M 11/045 440/88 L
6,273,771 B1 8/2001 Buckley et al.
6,669,517 B1 12/2003 Alby et al.
9,174,818 B1 11/2015 Langenfeld et al.
9,341,008 B1 5/2016 Amerling et al.
9,580,947 B1 2/2017 Amerling et al.
9,896,172 B1 2/2018 Pugh et al.
(Continued)

OTHER PUBLICATIONS

Alby et al., "Apparatuses for Supporting Outboard Motors with Respect to Marine Vessels", unpublished U.S. Appl. No. 16/043,280, filed Jul. 24, 2018.

(Continued)

*Primary Examiner* — Stephen P Avila

(57) ABSTRACT

An outboard motor has a top cowl and a service lid on the top cowl is movable into and between a closed position enclosing the powerhead compartment and an open position providing manual access to the powerhead compartment from above the outboard motor. An engine is in the powerhead compartment, wherein a peripheral gap is defined between the top cowl and the engine. A serviceable engine oil device is in the peripheral gap and is manually accessible from above the outboard motor when the service lid is in the open position. A serviceable transmission fluid device is in the peripheral gap and is manually accessible from above the outboard motor when the service lid is in the open position. A serviceable gearcase fluid device is in the peripheral gap and is manually accessible from above the outboard motor when the service lid is in the open position.

21 Claims, 12 Drawing Sheets

(56) References Cited

U.S. PATENT DOCUMENTS

| | | | | |
|---|---|---|---|---|
| 9,963,213 | B1 | 5/2018 | Jaszewski et al. | |
| 9,964,029 | B1 | 5/2018 | Loberger et al. | |
| 10,065,722 | B1 | 9/2018 | Jaszewski et al. | |
| 10,293,910 | B1 | 5/2019 | Torgerud et al. | |
| 10,502,312 | B1 | 12/2019 | Jaszewski et al. | |
| 10,723,427 | B1 | 7/2020 | Egleston et al. | |
| 10,800,502 | B1 | 10/2020 | Alby et al. | |
| 2001/0047907 | A1* | 12/2001 | Viken | F16H 57/0408 184/1.5 |

OTHER PUBLICATIONS

Jaszewski et al., "Oil Sump Housing for Outboard Motor", unpublished U.S. Appl. No. 16/938,464, filed Jul. 24, 2020.

Faust et al., "Cowlings and Latching Assemblies for Cowlings for Marine Drives", unpublished U.S. Appl. No. 16/986,669, filed Aug. 6, 2020.

Faust et al., "Cowlings for Marine Drives and Latching Devices for Cowlings for Marine Drives", unpublished U.S. Appl. No. 16/986,938, filed Aug. 6, 2020.

Amerling et al., "Cowlings and Hinge Assemblies for Cowlings on Marine Drives", unpublished U.S. Appl. No. 17/068,536, filed Oct. 12, 2020.

Reichardt et al., "Air Intake Plenum for Attenuating Sound from a Marine Engine", unpublished U.S. Appl. No. 17/081,388, filed Oct. 27, 2020.

* cited by examiner

TOP-DOWN SERVICEABLE OUTBOARD MOTORS

FIELD

The present disclosure relates to outboard motors, and more particularly to outboard motors that are efficiently serviceable when in the water.

BACKGROUND

The following U.S. patents and patent applications are incorporated herein by reference. Several of the patent applications are unpublished, but copies of these applications are filed herewith in exhibits and thus, along with the below-mentioned patents, constitute part of the original present disclosure, as-filed.

U.S. Pat. No. 6,273,771 discloses a control system for a marine vessel which incorporates a marine propulsion system that can be attached to a marine vessel and connected in signal communication with a serial communication bus and a controller. A plurality of input devices and output devices are also connected in signal communication with the communication bus and a bus access manager, such as a CAN Kingdom network, is connected in signal communication with the controller to regulate the incorporation of additional devices to the plurality of devices in signal communication with the bus whereby the controller is connected in signal communication with each of the plurality of devices on the communication bus. The input and output devices can each transmit messages to the serial communication bus for receipt by other devices.

U.S. Pat. No. 6,669,517 discloses a cowl structure having first and second cowl members that are independent components. A first cowl member is attachable, by a latch mechanism, to a support structure of the outboard motor. The second cowl member is attachable by a latch mechanism, to both the first cowl member and the support structure. The first cowl member extends across a rear portion of the outboard motor and at least partially along both port and starboard sides of the outboard motor. The second cowl member extends across a front portion of the outboard motor and at least partially along the port and starboard sides of the outboard motor. In a preferred embodiment, the second cowl member also extends partially over a top portion of the outboard motor and over a rear portion of the outboard motor.

U.S. Pat. No. 9,174,818 discloses a marine engine having a cylinder block having first and second banks of cylinders that are disposed along a longitudinal axis and extend transversely with respect to each other in a V-shape to define a valley therebetween. A catalyst receptacle is disposed at least partially in the valley and contains at least one catalyst that treats exhaust gas from the marine engine. A conduit conveys the exhaust gas from the marine engine to the catalyst receptacle. The conduit receives the exhaust gas from the first and second banks of cylinders and conveys the exhaust gas to the catalyst receptacle. The conduit reverses direction only once with respect to the longitudinal axis.

U.S. Pat. No. 9,341,008 discloses a hinge assembly for a cowl of an outboard motor. The hinge assembly is configured to connect a first portion of the cowl to a second portion of the cowl. The hinge assembly comprises an arm that is connected to one of the first and second cowl portions and a retainer that is connected to the other of the first and second cowl portions. The arm is movable with respect to the retainer between a registered position wherein the arm is retained by and pivotable with respect to the retainer to thereby pivotably connect the first portion of the cowl to the second portion of the cowl and an unregistered position wherein the arm is separated from the retainer so that the first portion of the cowl is separated from the second portion of the cowl.

U.S. Pat. No. 9,580,947 discloses a cowl for an outboard marine propulsion device having an internal combustion engine. The cowl comprises a first cowl portion; a second cowl portion that mates with the first cowl portion to enclose the internal combustion engine; a service door on the second cowl portion, wherein the service door is position-able in an open position and in a closed position; and a carrying handle on the second cowl portion, wherein the carrying handle is accessible when the service door is in the open position and inaccessible when the service door is in the closed position. A plurality of latches is spaced apart around the perimeter. The latches latch the second cowl portion to the first cowl portion. An actuator assembly actuates each of the plurality of latches. The actuator assembly can be actuated by movement of the carrying handle.

U.S. Pat. No. 9,896,172 discloses a lubrication system in a marine drive having a lubrication circuit that conveys lubrication to componentry of the marine drive and a lubrication service port connected to the lubrication circuit. The lubrication system further includes a pump disposed in the marine drive, wherein the pump pumps lubrication through the lubrication circuit. A hydraulic valve is connected to the lubrication circuit, wherein the hydraulic valve has a normal operating position wherein lubrication in the lubrication circuit is pumped by the pump to the componentry, and has a servicing position wherein lubrication in the lubrication circuit is pumped by the pump to the lubrication service port.

U.S. Pat. No. 9,963,213 discloses a system for mounting an outboard motor propulsion unit to a marine vessel transom. The propulsion unit's midsection has an upper end supporting an engine system and a lower end carrying a gear housing. The mounting system includes a support cradle having a head section coupled to a transom bracket, an upper structural support section extending aftward from the head section and along opposite port and starboard sides of the midsection, and a lower structural support section suspended from the upper structural support section and situated on the port and starboard sides of the midsection. A pair of upper mounts couples the upper structural support section to the midsection proximate the engine system. A pair of lower mounts couples the lower structural support section to the midsection proximate the gear housing. At least one of the upper and lower structural support sections comprises an extrusion or a casting.

U.S. Pat. No. 9,964,029 discloses a marine engine having a cylinder block with first and second banks of piston-cylinders that are vertically aligned and extend transversely with respect to each other in a V-shape to define a valley there between. A crankshaft is caused to rotate by the first and second banks of piston-cylinders. A flywheel is coupled to the upper end of the crankshaft such that rotation of the crankshaft causes rotation of the flywheel. An alternator is located above the cylinder block and coupled to the flywheel such that rotation of the flywheel operates the alternator.

U.S. Pat. No. 10,065,722 discloses an outboard marine engine having an internal combustion engine; a lower gearcase, a set of gears disposed in the lower gearcase, the set of gears being configured to transfer power from the internal combustion engine to drive a propulsor to generate a thrust on the outboard marine engine, and a dipstick that extends into the lower gearcase. The dipstick is removable from the lower gearcase and configured to indicate a level of lubrication in the lower gearcase.

U.S. Pat. No. 10,293,910 discloses a cooling system for a marine engine. The cooling system has a cooling fluid conduit that is configured to convey cooling fluid for cooling at least one component of the marine engine; a strainer disposed in the cooling fluid conduit and configured to strain the cooling fluid; and a quick connector that is manually operable to connect and disconnect the strainer from the cooling fluid conduit.

U.S. Pat. No. 10,502,312 discloses an outboard motor having an internal combustion engine that rotates a driveshaft disposed in a driveshaft housing, a transmission that is operatively connected to the driveshaft and is disposed in a transmission housing located below the driveshaft housing, a set of angle gears that operatively connect the transmission to a propulsor for imparting a propulsive force in a body of water, wherein the set of angle gears are located in a lower gearcase located below the transmission housing, and a lubrication system that circulates lubricant to and from the transmission.

U.S. Pat. No. 10,723,427 discloses an oil filter assembly for an engine of an outboard motor including a base having a high-pressure inlet port, a filter-mounting interface for receiving a filter, and a drain-back port for receiving a drain-back insert of the filter. The base includes an engine-mounting interface for mounting the base to the engine, which includes a high-pressure outlet port and a low-pressure outlet port providing oil to the engine. The base provides fluid communication between the high-pressure inlet port and an inlet side of the filter and between an outlet side of the filter and the high-pressure outlet port when the filter is installed and the drain-back insert is within the drain-back port. The base provides fluid communication between the drain-back port and the low-pressure outlet port when the drain-back insert is not within the drain-back port. A clean oil fill passageway is in fluid communication with the low-pressure outlet port.

U.S. Pat. No. 10,800,502 discloses an outboard motor having a powerhead that causes rotation of a driveshaft, a steering housing located below the powerhead, wherein the driveshaft extends from the powerhead into the steering housing; and a lower gearcase located below the steering housing and supporting a propeller shaft that is coupled to the driveshaft so that rotation of the driveshaft causes rotation of the propeller shaft. The lower gearcase is steerable about a steering axis with respect to the steering housing and powerhead.

Co-pending U.S. patent application Ser. No. 16/043,280, filed Jul. 24, 2018 and submitted herewith and intended to be part of the present disclosure, discloses an apparatus for supporting an outboard motor on a transom of a marine vessel. The apparatus has a transom bracket configured for fixed attachment to the transom; a supporting cradle that supports the outboard motor with respect to the transom bracket, wherein the supporting cradle is pivotable with respect to the transom bracket about a trim axis; and a trim actuator that is pivotally coupled to the transom bracket at a first trim actuator pivot axis and to the supporting cradle at a second trim actuator pivot axis. Extension of the trim actuator pivots the supporting cradle upwardly about the trim axis. Retraction of the trim actuator pivots the supporting cradle downwardly about the trim axis. The trim axis is located aftwardly of the first trim actuator pivot axis.

Co-pending U.S. patent application Ser. No. 16/938,464, filed Jul. 24, 2020 and submitted herewith and intended to be part of the present disclosure, discloses a cooling system for an outboard motor of a marine vessel. The cooling system includes an oil sump housing having an inner housing wall and an outer housing wall. The inner housing wall defines a transmission mounting cavity, and the inner housing wall and the outer housing wall defines an oil containment cavity that at least partially surrounds the transmission mounting cavity. The cooling system further includes a first sprayer nozzle and a second sprayer nozzle. Both the first sprayer nozzle and the second sprayer nozzle are coupled to the oil sump housing and configured to spray cooling fluid within the transmission mounting cavity onto an inner surface of the inner housing wall.

Co-pending U.S. patent application Ser. No. 16/986,669, filed Aug. 6, 2020 and submitted herewith and intended to be part of the present disclosure, discloses a cowling having first and second cowl portions that enclose a powerhead on a marine drive. A latching assembly is for latching the first and second cowl portions together. The latching assembly has a retainer portion fixed to the first cowl portion and a latching portion fixed to the second cowl portion. The latching portion comprises a latch arm and a bell crank, the latch arm and bell crank being rotatable into and between a latched position in which the latch arm is latched to the retainer portion and an unlatched position in which the latch arm is unlatched from the retainer portion. A detent mechanism mechanically retains the latch arm and bell crank in the latched position and alternately in the unlatched position.

Co-pending U.S. patent application Ser. No. 16/986,938, filed Aug. 6, 2020 and submitted herewith and intended to be part of the present disclosure, discloses a cowling for a marine drive. The cowling has first and second cowl portions for enclosing a powerhead, and a latching device which is movable into a latched position in which the powerhead is enclosed by the first cowl and second cowl portions and an unlatched position in which the second cowl portion is movable with respect to the first cowl portion so that the powerhead is accessible. The latching device has an electric actuator configured to automatically move the latching device from the latched position to the unlatched position and a manually-operable input device which is accessible from outside of the cowling and is configured to actuate the electric actuator to thereby automatically move the latching device from the latched position to the unlatched position.

Co-pending U.S. patent application Ser. No. 17/068,536, filed Oct. 12, 2020 and submitted herewith and intended to be part of the present disclosure, discloses a hinge assembly for a cowling on a marine drive. The cowling has a first cowl portion and a second cowl portion which together enclose a cowl interior. The hinge assembly has a first base frame configured for fixed attachment to an interior surface of the first cowl portion and a second base frame configured for fixed attachment to an interior surface of the second cowl portion. The second base frame is pivotally coupled to the first base frame by a connection device that enables manual removal of the second base frame from the intermediate frame without use of a tool, thus facilitating manual removal of the second cowl portion from the first cowl portion without the use of the tool.

Co-pending U.S. patent application Ser. No. 17/081,388, filed Oct. 27, 2020 and submitted herewith and intended to be part of the present disclosure, discloses an air intake plenum for a marine engine, the marine engine having first and second throttle devices for controlling flow of intake air to the marine engine. The air intake plenum has an airbox providing an expansion volume, first and second inlets that convey the intake air in parallel to the expansion volume, first and second outlets that convey the intake air in parallel from the expansion volume to the first and second throttle devices, and first and second Helmholtz-style attenuator devices located at the first and second outlets, respectively. Together the first and second inlets, expansion volume, and first and second Helmholtz-style attenuator devices are configured to attenuate different frequencies of sound emanating from the marine engine via the first and second outlets.

SUMMARY

This Summary is provided to introduce a selection of concepts that are further described herein below in the Detailed Description. This Summary is not intended to identify key or essential features of the claimed subject matter, nor is it intended to be used as an aid in limiting the scope of the claimed subject matter.

An outboard motor is for propelling a marine vessel in a body of water. The outboard motor comprises a top cowl and a service lid on the top cowl; a powerhead compartment defined within the top cowl, wherein the service lid is movable into and between a closed position enclosing the powerhead compartment and an open position providing manual access to the powerhead compartment from above the outboard motor; an engine in the powerhead compartment, wherein a peripheral gap is defined between the top cowl and an air intake plenum on the engine; a transmission that operatively couples the engine to a propulsor for generating a thrust force in the body of water, wherein the propulsor is supported within a gearcase located below the powerhead compartment; a serviceable engine oil device in the peripheral gap and being manually accessible from above the outboard motor when the service lid is in the open position, for addition and removal of engine oil; a serviceable transmission fluid device in the peripheral gap and being manually accessible from above the outboard motor when the service lid is in the open position, for addition and removal of transmission fluid; and a serviceable gearcase fluid device in the peripheral gap and on an opposite side of the engine relative to the serviceable transmission fluid device, the serviceable gearcase fluid device being manually accessible from above the outboard motor when the service lid is in the open position, for addition and removal of gearcase fluid to and from the gearcase.

In certain examples, the outboard motor further comprises an emergency steering release device in the peripheral gap and being manually accessible from above the outboard motor when the service lid is in the open position, for manually actuating a steerable lower gearcase of the outboard motor; an engine control unit (ECU) for controlling the engine and an engine diagnostic connector device in the peripheral gap and being manually accessible from above the outboard motor when the service lid is in the open position, for connecting a diagnostic link to the ECU; a fuse box containing electrical fuses for the outboard motor, the fuse box being in the peripheral gap and having a removable cover that is manually accessible from above the outboard motor when the service lid is in the open position, for replacement of the electrical fuses therein; and/or an alternator belt for the engine, the alternator belt being located above the engine and below an intake airbox for the engine, and being manually accessible from above the outboard motor when the service lid is in the open position and the intake airbox is removed, facilitating replacement of the alternator belt from above the outboard motor.

Various other features, objects, and advantages of the invention will be made apparent from the following description taken together with the drawings.

BRIEF DESCRIPTION OF THE DRAWINGS

The present disclosure includes the following Figures.

DETAILED DESCRIPTION

During research and experimentation in the field of outboard motors, the present inventors recognized it is desirable to configure an outboard motor such that it is fully serviceable during routine service events, in particular while the outboard motor remains coupled to the marine vessel and in the water. The inventors recognized it would be preferable to configure the outboard motor in a way that facilitates all routine maintenance and diagnostic procedures. The present inventors realized that providing such a configuration would provide significant ease-of-use advantages to the owner, including avoidance of a need to remove the outboard motor from the water, which can be costly and time consuming. Routine service events include but are not necessarily limited to checking and as necessary evacuating and filling engine oil, transmission fluid, and gearcase fluid; checking and as necessary replacing the engine oil filter, engine fuses, and engine alternator drive belt; and electronically connecting to the engine control unit via a diagnostic link to enact an engine diagnostic check. In certain embodiments, the present inventors also determined it would be advantageous to provide the operator of the outboard motor with manual access to a steering bypass linkage which upon failure of a steering system for the outboard motor facilitates emergency steering of the steering system, thus enabling the operator to navigate the marine vessel back to the harbor.

The present disclosure arose based upon the inventors' recognition of the above challenges existing within the prior art.

Figure 1:
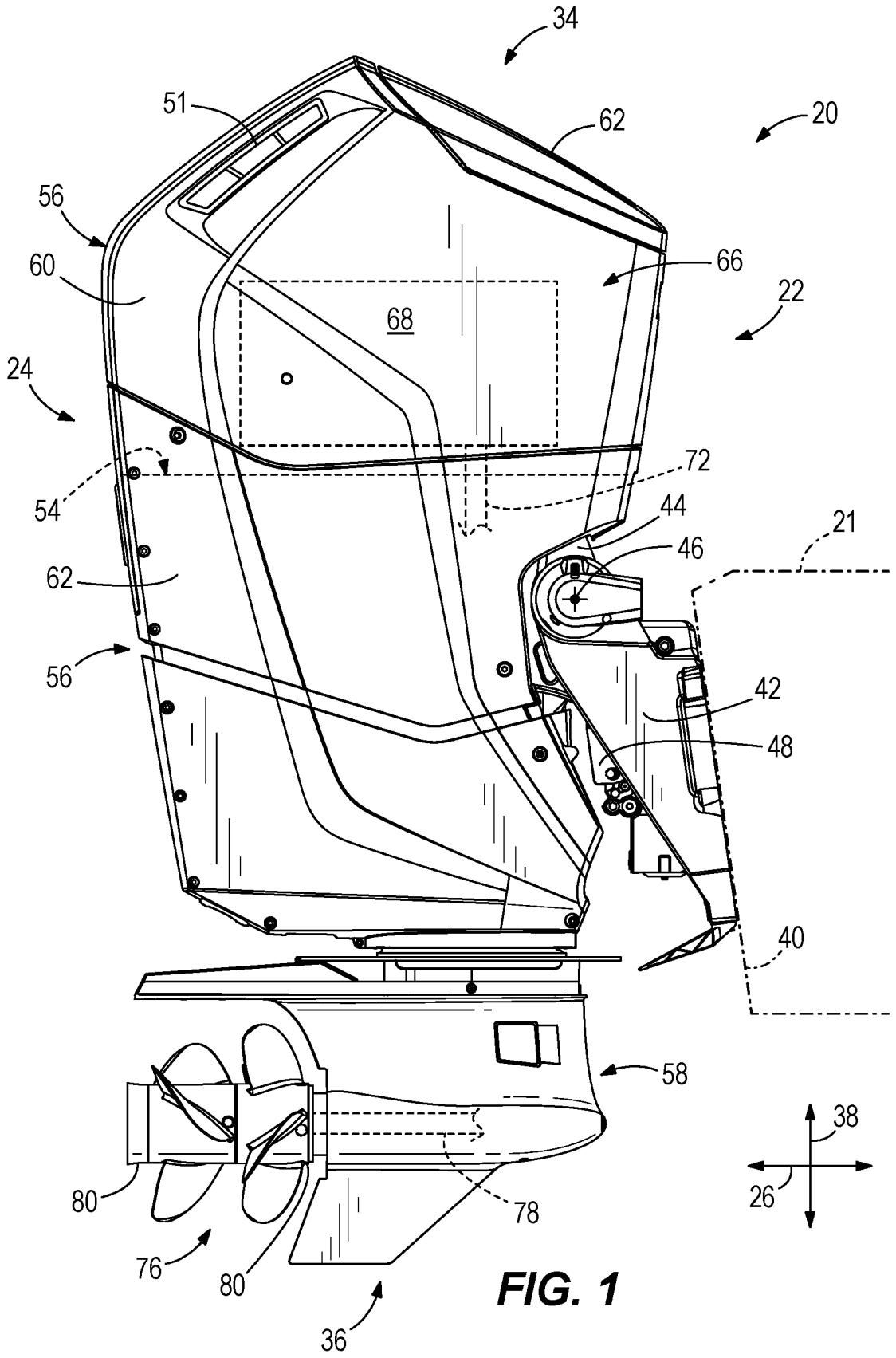
FIG. 1 is a starboard side view of an outboard motor coupled to a marine vessel by a transom bracket.
Figure 2:
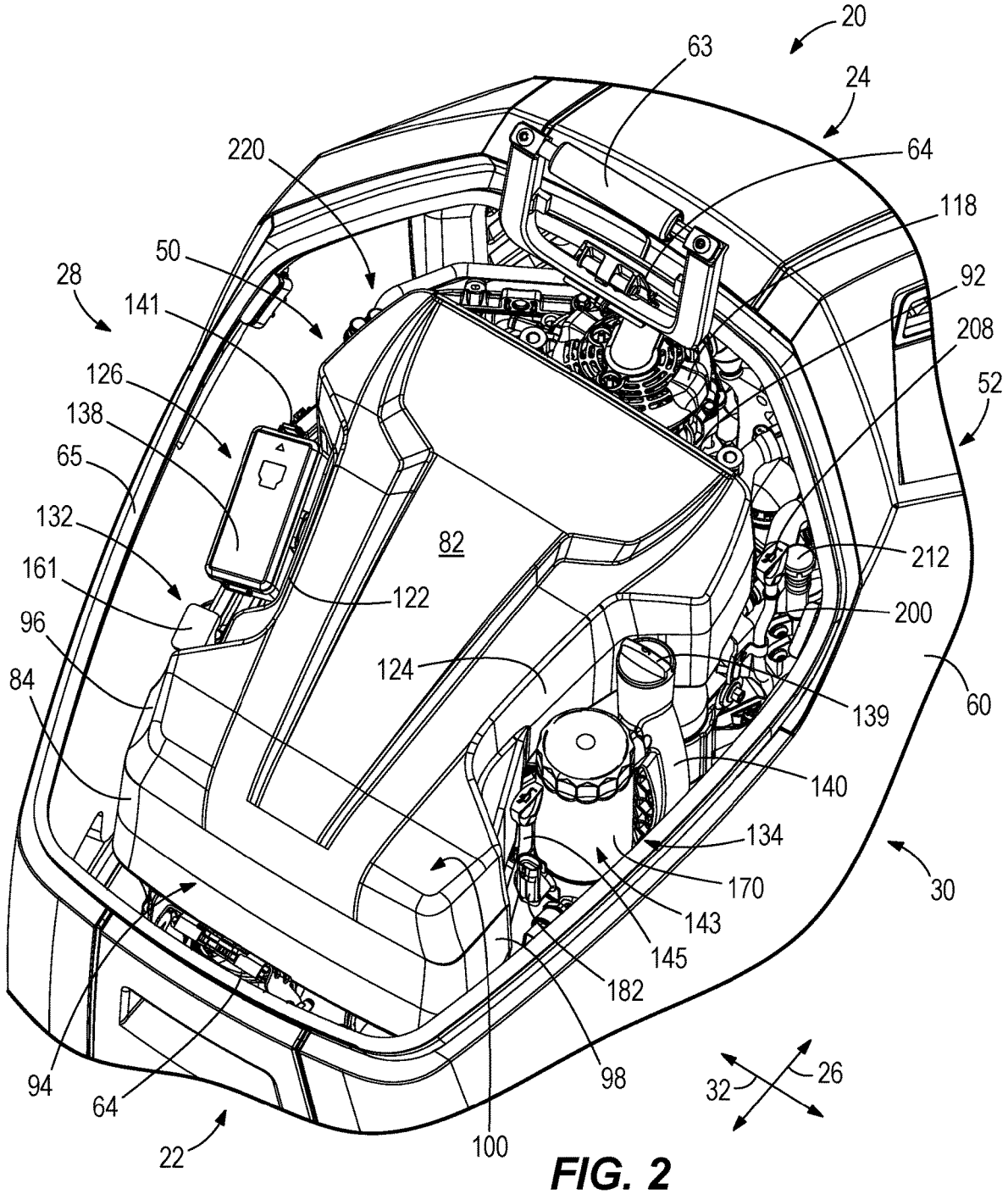
FIG. 2 is a port side top view from a front of the outboard motor, showing a powerhead compartment of the outboard motor having a service lid removed.

FIGS. 1 and 2 depict an outboard motor 20 for propelling a marine vessel 21 in a body of water. The outboard motor 20 extends from front 22 to rear 24 in a longitudinal direction 26, from starboard side 28 to port side 30 in a lateral direction 32 that is perpendicular to the longitudinal direction 26, and from top 34 to bottom 36 in an axial direction 38 that is perpendicular to the longitudinal direction 26 and perpendicular to the lateral direction 32.

The outboard motor 20 is coupled the transom 40 of the marine vessel 21 via transom bracket 42, which is disclosed and claimed in the presently incorporated U.S. patent application Ser. No. 16/043,280. In other examples the transom bracket 42 can be a conventional configuration. The outboard motor 20 comprises a rigid supporting cradle 44 that is pivotably coupled to the transom bracket 40 along a trim axis 46. A trim actuator 48 is coupled to the transom bracket 40 and supporting cradle 44 and allows an operator to trim the outboard motor 20 up and down about the trim axis 46 relative to the marine vessel 21 and transom bracket 42.

The outboard motor 20 has a powerhead compartment 50 defined within a top cowl 52 and above a pass-through plate 54, which is located above the supporting cradle 44 and extends longitudinally and laterally relative to the outboard motor 20. The outboard motor 20 has a midsection 56 that extends downwardly from the top cowl 52, and a gearcase 58 located below the midsection 56.

The top cowl 52 is configured according to the novel embodiments disclosed and claimed in the incorporated U.S. patent application Ser. Nos. 16/986,669; 16/986,938; and 17/068,536. As described U.S. patent application Ser. No. 16/986,669, the top cowl 52 has a cowl body 60 that is rigidly coupled to chaps 62 covering the midsection 56, via for example fasteners and latches. As described in U.S. patent application Ser. No. 17/068,536, the top cowl 52 also has a service lid 62 which is pivotably and optionally removably coupled to the cowl body 60 by a hinge device 64. FIG. 1 shows the service lid 62 in a closed position, enclosing the powerhead compartment 50 and FIG. 2 shows the top cowl 52 when the service lid 62 is removed, which exposes the contents of the powerhead compartment 50. When the service lid 62 is removed, a carrying handle 63 projects upwardly from the cowl body 60, as disclosed in more detail in the presently incorporated U.S. patent applications. Optionally as disclosed in U.S. patent application Ser. No. 16/986,938, an electronically-actuatable latching device 64 is located on the front 22 of the outboard motor 20 and is manually operable to latch and unlatch the service lid 62 relative to the cowl body 60. In the closed position, the service lid 62 mates with the cowl body 60 along a perimeter edge 65 of the cowl body 60, which surround the powerhead compartment 50. Optionally, a decal (not shown) containing service instructions can be displayed on the inside surface of the service lid 62, providing the technician with guidance regarding servicing. In other examples, features of the top cowl 52 shown and described in the referenced co-pending patent applications, such as the hinges and rigid connections of the top cowl to the midsection 56, can instead be conventional items. For example it is not essential that the service lid 62 is fully removable in the manner taught in the referenced patent applications.

Figure 6:
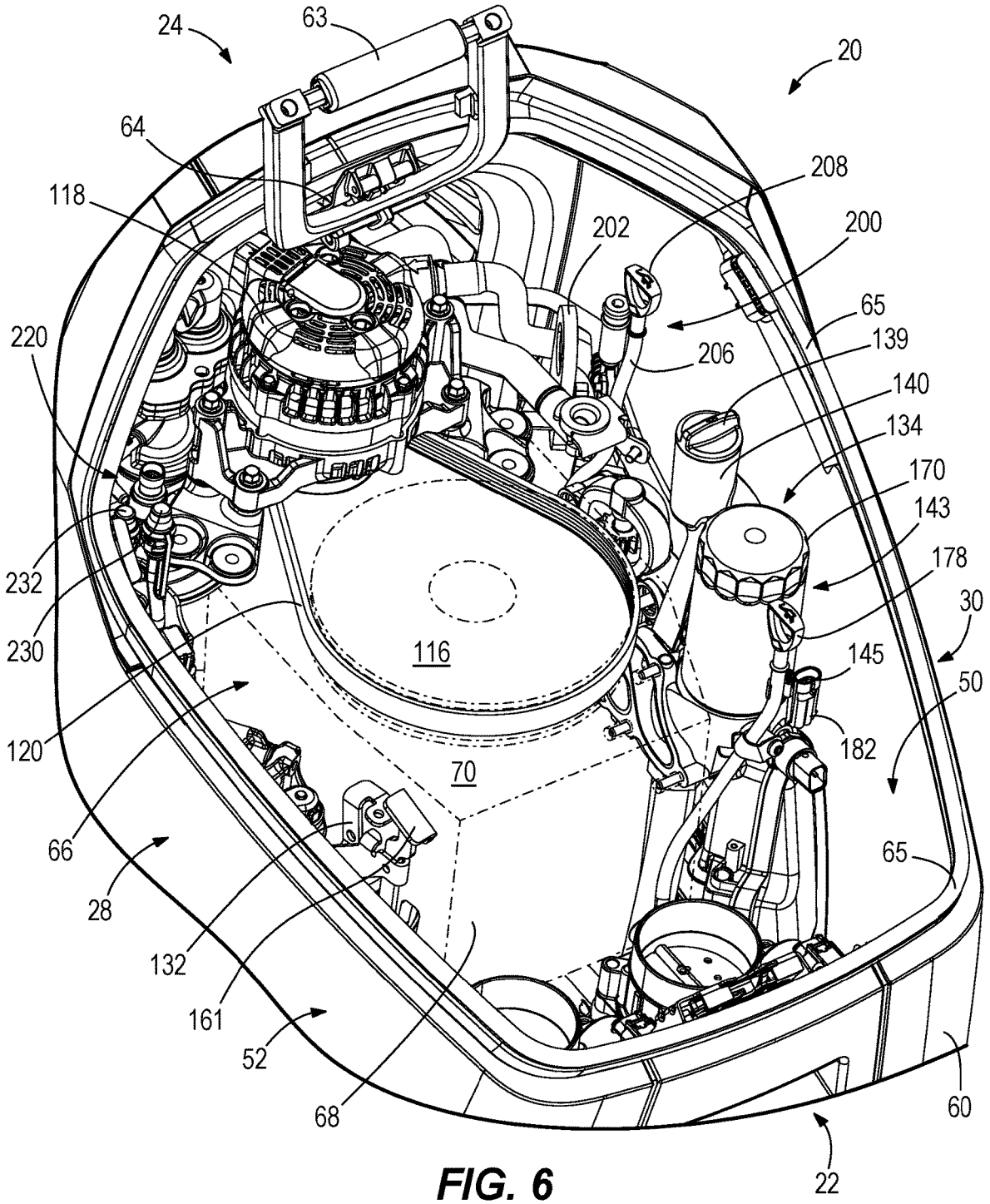
FIG. 6 is a starboard side top view of the powerhead compartment from the front of the outboard motor, having the air intake box removed for servicing of an alternator belt.
Figure 7:
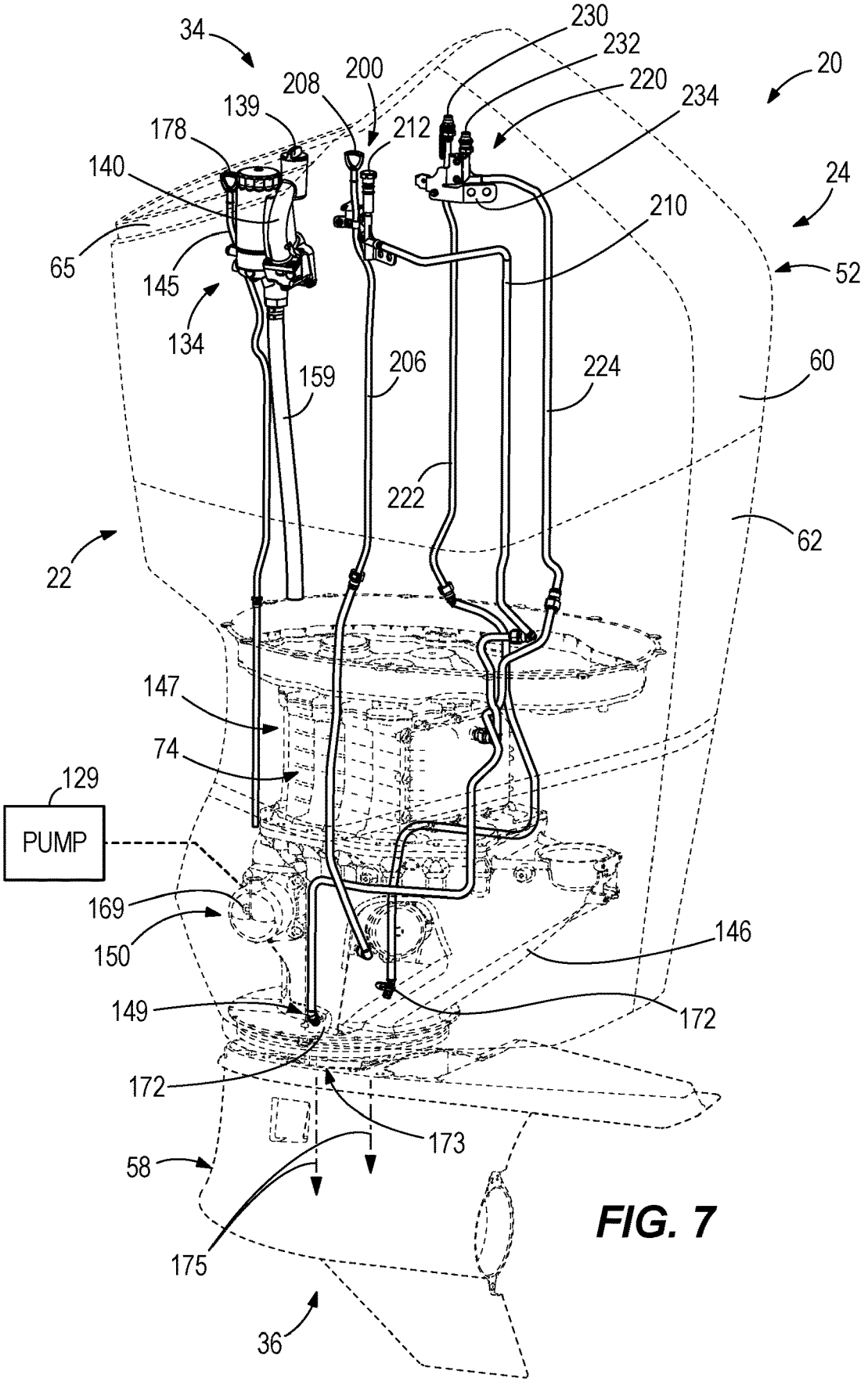
FIG. 7 is a port side view of the outboard motor, showing engine lubricant, transmission fluid, and gearcase fluid fill, extraction, and vent conduits.

Referring to FIGS. 1, 6, and 7, the outboard motor 20 includes a powerhead 66 disposed in the powerhead compartment 50. The powerhead 66 includes, among other things, an internal combustion engine 68, which is shown schematically in FIG. 6. As conventional and disclosed in U.S. Pat. No. 9,174,818, the internal combustion engine 68 has a cylinder block with first and second banks of cylinders that extend transversely with respect to each other in a V-shape. A crankcase shown schematically at reference number 70 in FIG. 6 is attached to the noted cylinder block. Optionally, the crankcase 70 can include a bedplate and a crankcase cover, as disclosed in several of the presently incorporated patents. Operation of the engine 68 causes rotation of a crankshaft in the crankcase 70, which in turn causes rotation of a driveshaft 72 extending downwardly from the engine 68 into the midsection 56. The driveshaft 72 is operably coupled via a transmission 74 in the midsection 56 to a propulsor 76 in the gearcase 58, such that rotation of the driveshaft 72 causes rotation of the propulsor 76 to thereby create a thrust force in the body of water which propels the outboard motor 20 and the marine vessel 21. The driveshaft 72 normally rotates forwardly and the transmission 74 operatively engages the driveshaft 72 with the propulsor 76 in forward and reverse gears, and operatively disengages the components in neutral, as is conventional. The type and configuration of the propulsor 76 can vary from what is shown and described. In the illustrated example, the propulsor 76 includes counter-rotating propeller shafts 78 and one or more propellers 80 coupled to the propeller shafts 78 such that rotation of the propeller shafts 78 causes rotation of the propellers 80, as is conventional.

The powerhead 66 is supported with respect to the outboard motor 20 by the supporting cradle 44, which can be configured in the manner disclosed in U.S. Pat. No. 9,969,475. The supporting cradle 44 is a rigid truss-like member that is pivotably mounted to the marine vessel 21. As explained in U.S. Pat. No. 9,969,475, the supporting cradle 44 has rubber mounts that resiliently support the powerhead 66 with respect to the supporting cradle 44, in particular such that vibration and other movements of the engine 68 are not directly transmitted to the marine vessel 21 via the transom bracket 40, but instead are absorbed by the noted mounts of the supporting cradle 44. This is a known mounting configuration, as disclosed in U.S. Pat. No. 9,969,475, wherein the supporting cradle 44 and related components are often referred to as an "unsprung mass" and the engine 68 and related components are often referred to as a "sprung mass". The sprung mass is movable relative to the unsprung mass, with such movement being caused by for example vibration of the engine 68.

Figure 3:
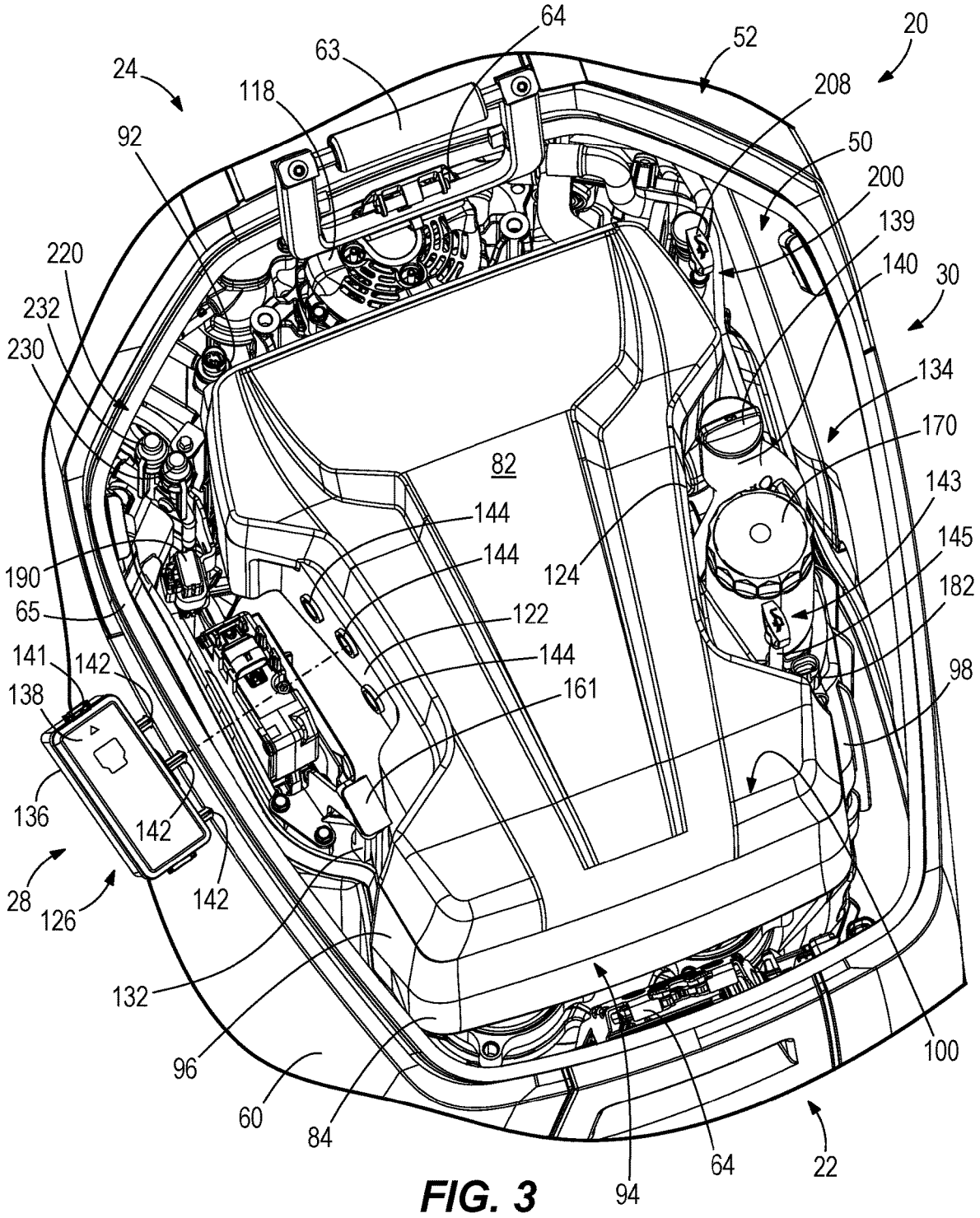
FIG. 3 is a starboard side top view of the powerhead compartment from the front of the outboard motor.
Figure 4:
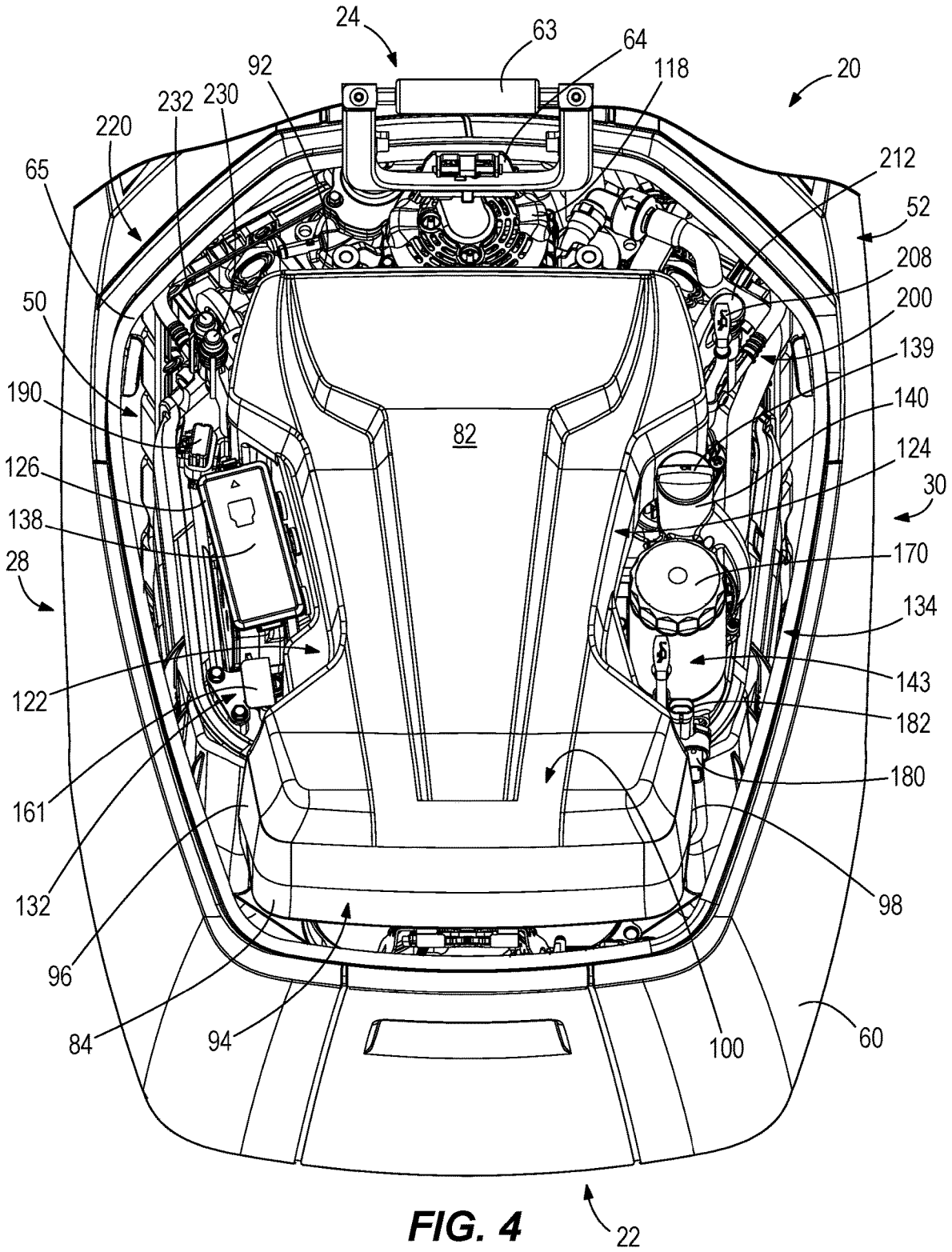
FIG. 4 is a top view of the powerhead compartment from the front of the outboard motor.

As shown in FIGS. 2-4, an air intake plenum 82 is in the powerhead compartment 50, on top of the engine 68, and is specially configured for conveying intake air to the engine 68. A peripheral gap exists between the powerhead 66, including but not limited to the engine 68 and air intake plenum 82, and the perimeter edge 65 of the top cowl 52. The peripheral gap extends around the entire powerhead 66. The present inventors recognize that the peripheral gap must be sized large enough (e.g., peripherally wide enough) to permit vibration and other normal operational movements of the sprung pass, including the powerhead 66, relative to the unsprung mass, including the top cowl 52. Thus, from an operational standpoint it is desirable to provide the outboard motor 20 with a relatively large/wide peripheral gap. However, as the consumer demand for outboard motors having increased power in a small package size continues, it remains desirable to provide an outboard motor with a relatively small/narrow peripheral gap. These countervailing objectives presented the present inventors with significant design challenges, particularly when considered in conjunction with the above-described objective of providing an outboard motor that is fully serviceable during routine maintenance, from above the powerhead compartment, while the outboard motor remains on the marine vessel and in the water.

As shown in FIGS. 2-5, the air intake plenum 82 is configured in the manner disclosed in U.S. patent application Ser. No. 17/081,388. More particularly, the air intake plenum 82 has an airbox 84 providing an expansion volume for the intake air. The airbox 84 has starboard and port inlets 86 that convey the intake air in parallel to the expansion volume, and starboard and port outlets 88 that convey the intake air in parallel from the expansion volume to starboard and port throttle devices 90 of the engine 68. As further shown and described in U.S. patent application Ser. No. 17/081,388, the air intake plenum 82 also has first and second Helmholtz-style attenuator devices located at the starboard and port outlets 88, respectively. Together the starboard and port inlets 86, expansion volume, and starboard and port Helmholtz-style attenuator devices are configured to attenuate different frequencies of sound emanating from the engine 68. The intake air enters the powerhead compartment 50 via intake air openings 51 (see FIG. 1) in the top cowl 52.

The airbox 84 extends from rear 92 to front 94 in the longitudinal direction 26, from starboard side 96 to port side 98 in the lateral direction 48, and from top 100 to bottom 102 in the axial direction 38. The airbox 84 is generally L-shaped when viewed from the starboard and port sides 96, 98, such that the starboard and port inlets 86 face the longitudinal direction 26 and the starboard and port outlets 88 face the axial direction 38, transversely relative to the starboard and port inlets 86. The starboard and port inlets 86 are laterally spaced apart from each other, each having a wire mesh cover 97 that filters particulate material from the incoming intake air. The front 94, particularly along the bottom 102, is mounted to the starboard and port throttle devices 90. The front 94, particularly along the bottom 102, is mounted to the engine 68. In the illustrated example, the front 94 is press-fit mounted to the throttle devices 90 via rubber cups 104, which form tool-less press-fit couplings with end flanges 106 on the starboard and port outlets 88. The end flanges 106 engage in a male-female relationship with the rubber cups 104 (FIG. 5) and a spring clamp is applied on the diameter. This provides a resilient coupling that can be conveniently manually press-fit, so the technician does not have to use tools to disconnect or connect the front 94 of the airbox 84 from the powerhead 66. This is advantageous because there is very little clearance between the front 94 of the airbox 84 and the perimeter edge 65 of the cowl body 60. That is, the noted peripheral gap in this location is narrower than a typical technician's hands. The press-fit couplings thus advantageously facilitate manual removal of the airbox 84 from above the powerhead compartment 50, which otherwise would not be possible if fixed-type fasteners requiring tools were utilized. The rear 92 of the airbox 84 is fixedly mounted to the powerhead 66 via an eyelet bracket 110 adjacent the inlet 86 on the starboard side 96 of the airbox 84. A fastener 112 extends through the eyelet bracket 110 and into engagement with a hole 113 on the starboard side lifting eye 114 of the powerhead 66. The fastener 112 is manually accessible from above the powerhead compartment 50 so that the technician can use a manual tool, such as a screwdriver, to easily loosen and remove the fastener 112, thus freeing the airbox 84 for removal, as shown in FIG. 5.

Figure 5:
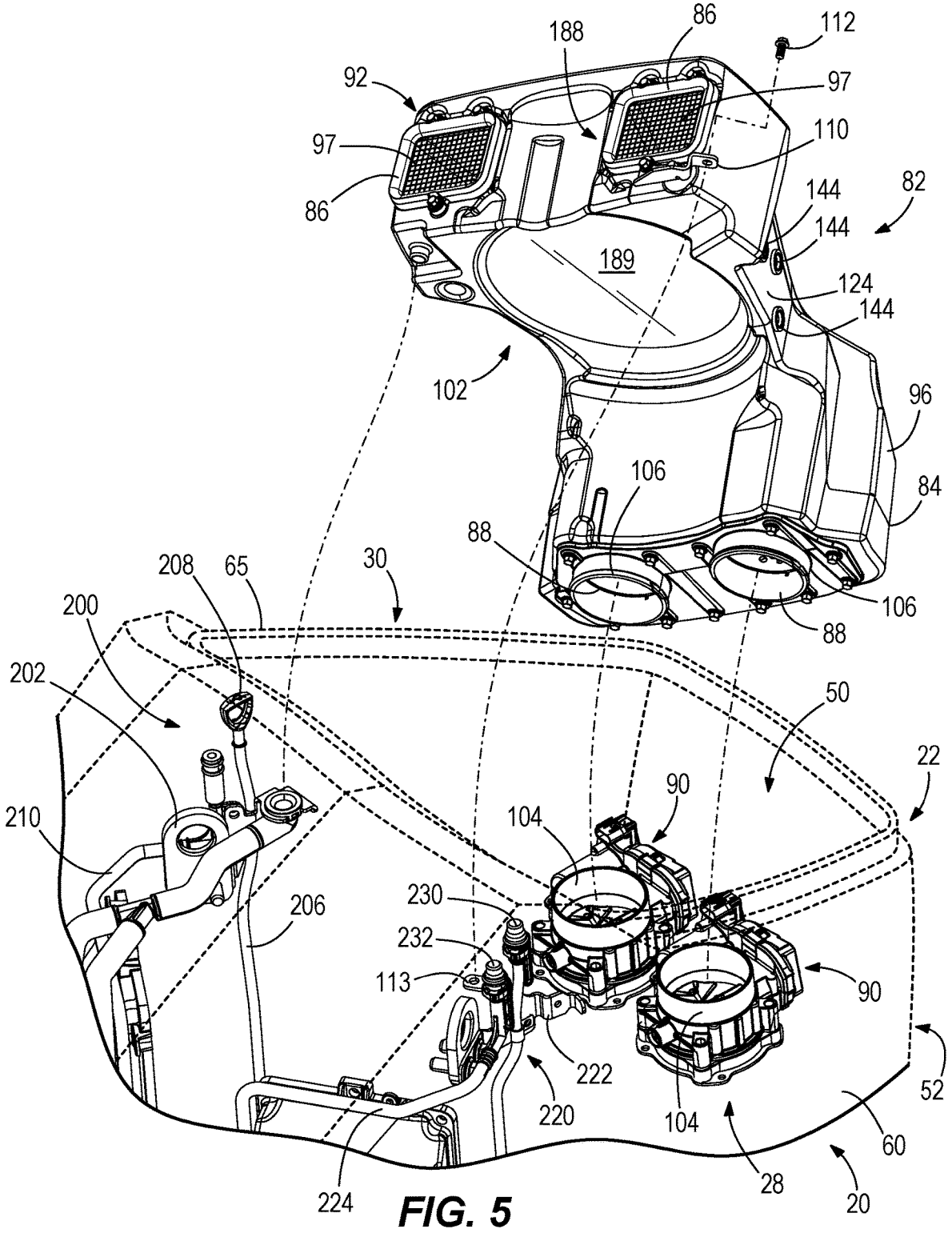
FIG. 5 is a starboard side exploded view of the outboard motor showing removal of an air intake box from the powerhead compartment.

Referring to FIGS. 5 and 6, the airbox 84 is located on top of a flywheel 116 of the engine 68 and has a concave recess 188 along the front 92, which fits around an alternator 118 mounted on top of the powerhead 66 when the airbox 84 is fastened in place. The airbox 84 also has a circular recess 189 on its the bottom 102 for positioning over the flywheel 116. The flywheel 116 is connected to the alternator 118 by a belt 120, which optionally can be a rubber (stretchy) belt. The belt 120 can be manually serviced and/or replaced from above the powerhead compartment 50 by first manually removing the air intake plenum 82 and then removing the belt 120, or for example cutting the belt 120 off the flywheel 116. A new belt can then be installed, via for example manual tools and a known process of removing the alternator 118 and cranking the engine and "walking" the belt onto the outer diameter of the flywheel 116. Reference is made to U.S. Pat. No. 9,964,029, for further description of the flywheel 116, alternator 118, and belt 120.

Removal of the airbox 84 also advantageously provides manual access to removable and replaceable sprayers attached to an exhaust manifold of the engine 68, configured for spraying cooling water into the exhaust emitted from the engine 68. The exhaust manifold and sprayers are shown and described in the presently incorporated U.S. patent application Ser. No. 16/938,464, among several other commonly owned U.S. patents describing these features, for example the presently incorporated U.S. Pat. No. 10,293,910.

Referring to FIGS. 2-4, the starboard and port sides 96, 98 of the airbox 84 have starboard and port recessed wall portions 122, 124 which are longitudinally centrally located along the starboard and port sides 96, 98 and are laterally inwardly recessed, towards each other, so as to provide starboard and port laterally enlarged gap portions relative to the perimeter edge 65 of the cowl body 60, for location of several serviceable devices of the outboard motor 20, thus facilitating routine service from above the outboard motor 20 for example while the outboard motor 20 remains in the water. As will be further explained herein below, the serviceable devices in the starboard laterally enlarged gap portions include but do not have to be limited to: a fuse box 126 containing electrical fuses for the outboard motor 20 and an emergency steering release device 132 for manually actuating a steering actuator associated with steering the gearcase 58 of the outboard motor 20. The serviceable device in the port laterally enlarged gap portion is but do not have to be limited to an engine oil device 134 facilitating addition and removal of engine oil and a filter for the engine oil.

Referring to FIG. 3, the fuse box 126 includes a body 136 and a cover 138 that is attached to the body 136 by for example a clasp 141, to enclose electrical fuses associated with the outboard motor 20. The fuse box 126 is in the noted laterally enlarged gap portion and is manually accessible from above the powerhead compartment 50 when the service lid 62 is open or removed. The cover 138 is openable or removable from the body 136 by operation of the clasp 141, which permits manual repair and/or replacement of the electrical fuses therein. A rigid bundle of electrical connectors (not shown) extends through the bottom of the body 136 into electrical connection with the electrical fuses and provides support for the body 136. The fuse box 126 is mounted to the starboard side 96 of the airbox 84, along the recessed wall portion 122. Three barbed grommet projections 142 extend into snap-fit connection with corresponding bores 144 formed in the recessed wall portion 122. During servicing, the technician can manually remove the fuse box 126 from the recessed wall portion 122 by manually pinching the barbed grommet projections 142 and/or grabbing the fuse box 126 and applying enough pulling force in the laterally outward direction to disengage the barbed grommet projections 142 from the corresponding bores 144. This facilitates easy manual removal and repair/replacement of the fuse box 126, if needed, from above the powerhead compartment 50.

Referring now to FIGS. 6, 7, 12 and 13, the emergency steering release device 132 is located in the starboard laterally enlarged gap portion and interfaces with a hydraulic steering system of the outboard motor 20, which is configured to steer the gearcase 58 about a steering axis and relative to the remainder of the outboard motor 20, as described in U.S. Pat. No. 10,800,502. Briefly, as fully explained in U.S. Pat. No. 10,800,502, the outboard motor 20 has a steering housing 146 in the lower half of the midsection 56, above the gearcase 58. An extension of the driveshaft 72 extends through the steering housing 146 and into operable engagement with the propeller shafts 78 in the gearcase 58. A steering column located generally at reference number 149 is rigidly coupled to the gearcase 58 and extends upwardly into the steering housing 146. A hydraulic cylinder 150 located on the steering housing 146 engages with the steering column 149 via a rack and pinion. The rack and pinion are not shown in FIG. 7, but it is shown in the presently incorporated '502 patent. The steering system further includes a hydraulic pump 129 and associated control valve that pumps hydraulic fluid to the noted hydraulic cylinder to cause lateral movement and rotational movement of the rack and pinion and commensurate steering rotation of the steering column 149 and gearcase 58 relative to the steering housing 146 and midsection 56 of the outboard motor.

Figure 13:
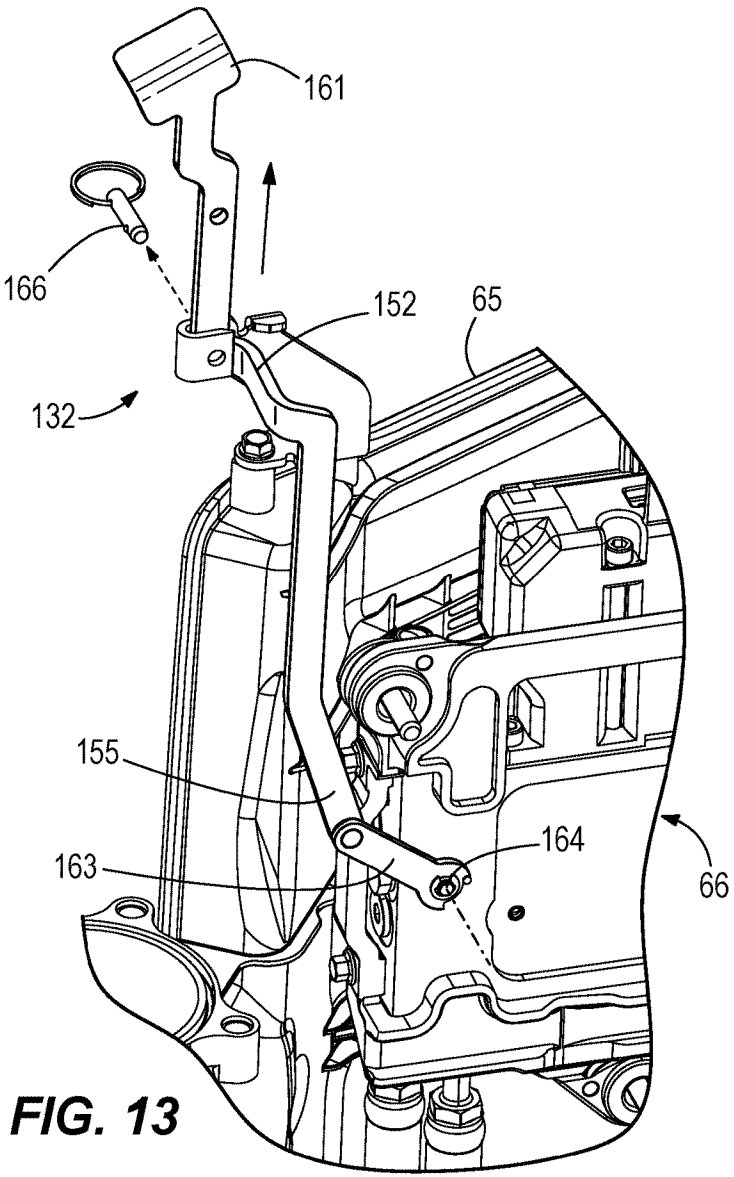
FIGS. 12 and 13 are perspective views of an emergency steering release device in a disengaged position and in an engaged position, respectively.
Figure 12:
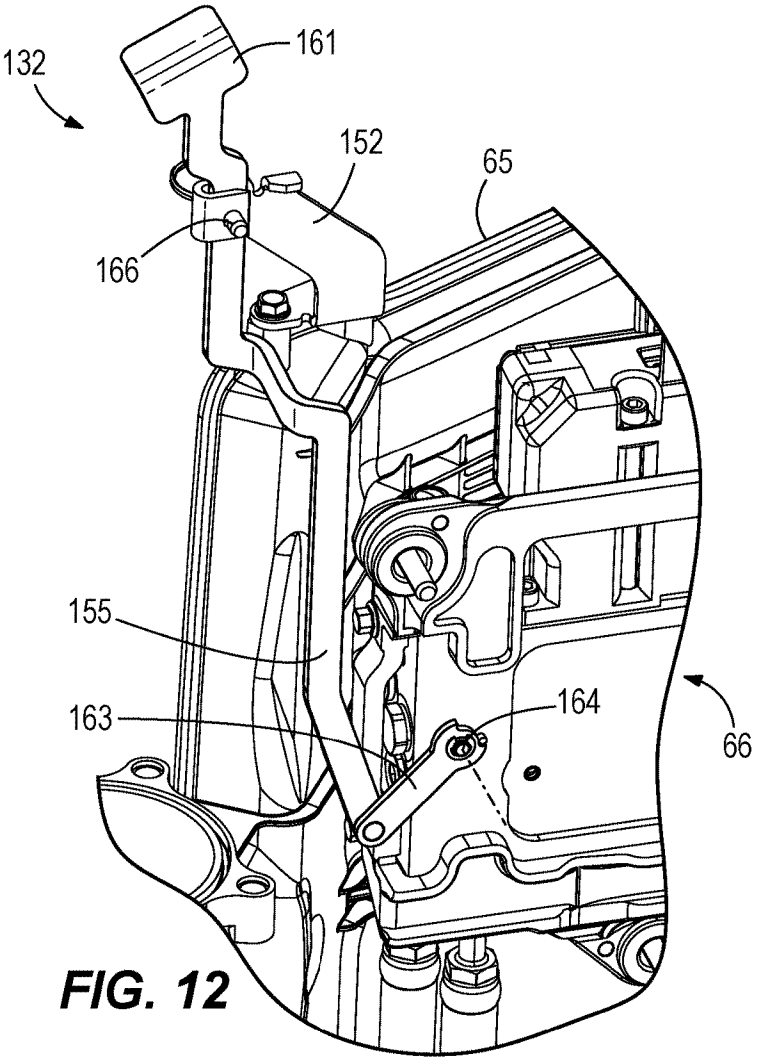

Referring to FIGS. 7, 12 and 13, the emergency steering release device 132 includes a handle 161 which can be manually grasped by the technician from above the powerhead compartment 50. The handle 161 is supported by a retainer bracket 152 and has an inner end 155 that is pivotably coupled to the powerhead 66 by a crank arm 163 at a crankshaft 164. A clevis pin 166 fastens the handle 161 with respect to the retainer bracket 152. Manually removing the clevis pin 166 and pulling the handle 161 upwardly into the position shown in FIG. 13, pivots the crank arm 163 and rotates the crankshaft 164 about its own axis, which disconnects hydraulic ports of the steering system of the outboard motor 20, in particular allowing free movement of the gearcase 58 about the steering axis relative to the steering housing 146 and midsection 56. More specifically, pulling up on the handle 161 short circuits the port and starboard end caps 169 of the hydraulic cylinder 150 relative to the noted pump 129 and control valve, so there becomes very little or no hydraulic resistance to steering of the gearcase 58 via the noted rack and pinion. See also U.S. Pat. No. 10,800,502. It becomes possible to use physical force to move the gearcase 58 or as explained further herein below use the engine 68 and shifting of the transmission 74, effectively using driveshaft torque to steer the gearcase 58.

The emergency steering release device 132 is particularly useful in applications wherein there is a single outboard motor on the marine vessel 21, and when the steering system of the outboard motor 20 fails when the marine vessel 21 is on the water away from the harbor. A failure of the steering system could occur for example upon failure of a hydraulic pump or valve associated with the system. In such situations, the operator can open the service lid 62, remove the clevis pin 166, and pull upon the handle 161, which as described above bypasses the control valve of the steering system and permits movement of the noted rack and pinion. The operator is also able to shift the transmission 74 into forward gear and apply throttle via a throttle/shift lever at the helm of the marine vessel 21. Applying demand in forward and reverse gears will cause the gearcase 58, which is freed for movement via the emergency steering release device 132, to steer in either direction relative to the midsection 56. Applying demand in forward gear will cause reactionary forces on the gearcase 58 that steer the gearcase 58 in one direction relative to the midsection 56. Applying demand in reverse gear will cause reactionary forces on the gearcase 58 that steer in the opposite direction relative to the midsection 56. The steering movement of the gearcase 58 is a resultant of the torque transmitted by the driveshaft 72 through the axis of the steering joint between the steering housing 146 and the gearcase 58. See U.S. Pat. No. 10,800,502. This functionality is unique to an outboard motor having a steerable lower gearcase, such as is depicted in the figures, wherein shifting takes place outside of the gearcase 58 and before the noted steering joint. Thus, with the emergency steering release device 132 and throttle/shift lever, the operator can free the gearcase 58 for steering movement, and then follow the above-described operation to center the gearcase 58, i.e., to get it straight forward in the longitudinal direction 26. This advantageously enables the operator to steer the marine vessel 21 to the harbor.

Figure 9:
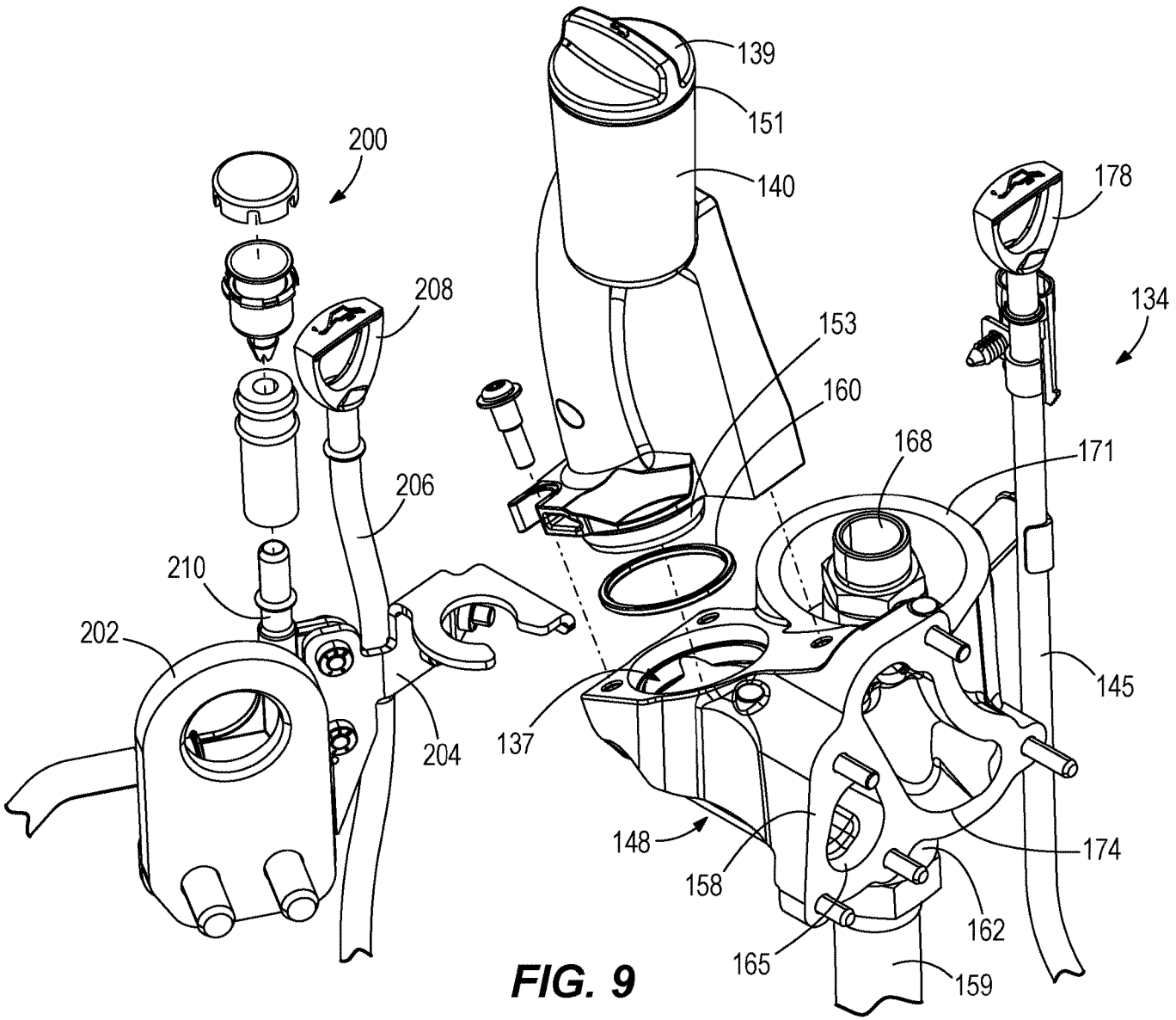
FIG. 9 is an exploded view of the serviceable engine oil device and serviceable transmission fluid device.
Figure 10:
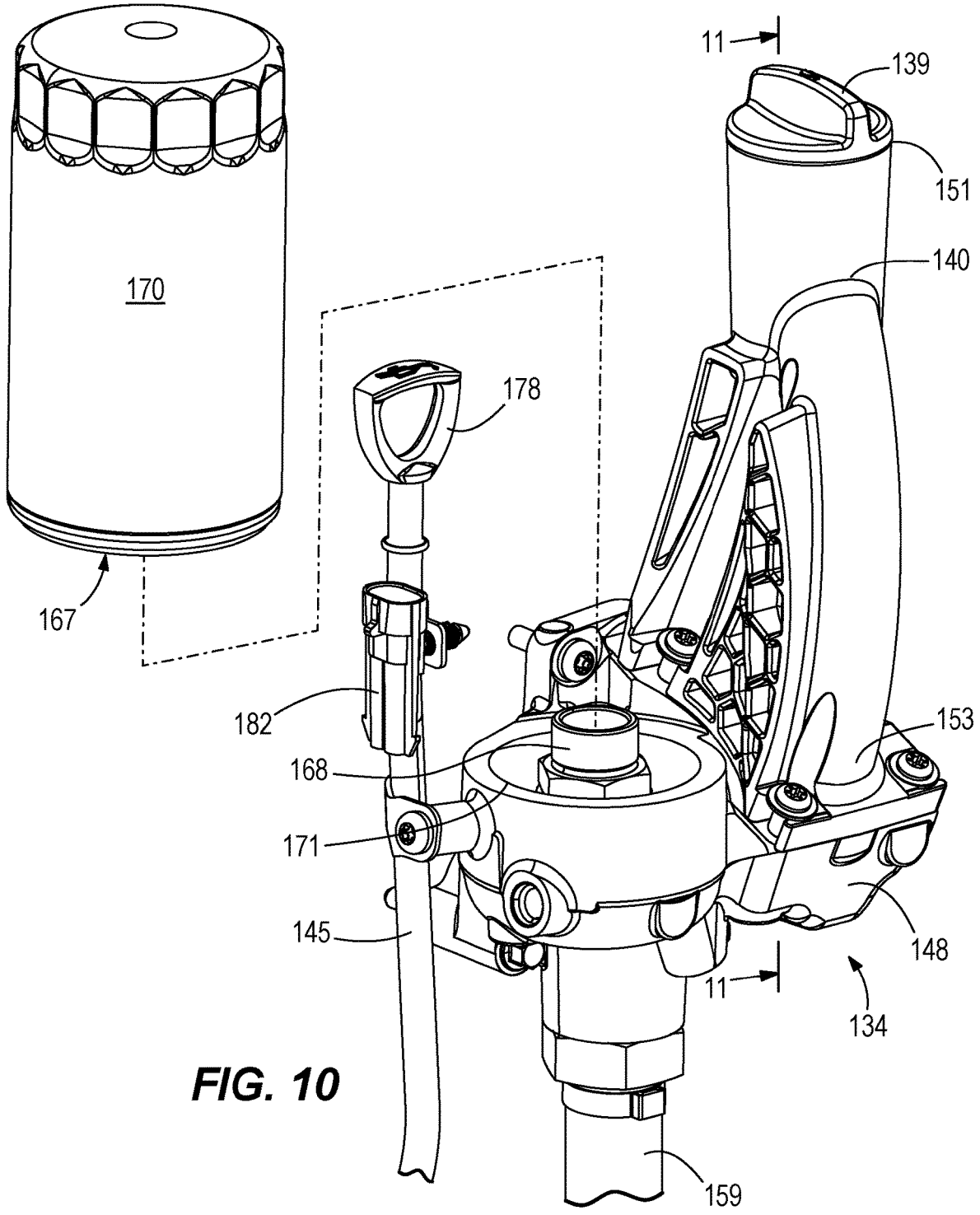
FIG. 10 is an exploded view of the serviceable engine oil device showing removal of a canister and filter element of the oil filter.
Figure 11:
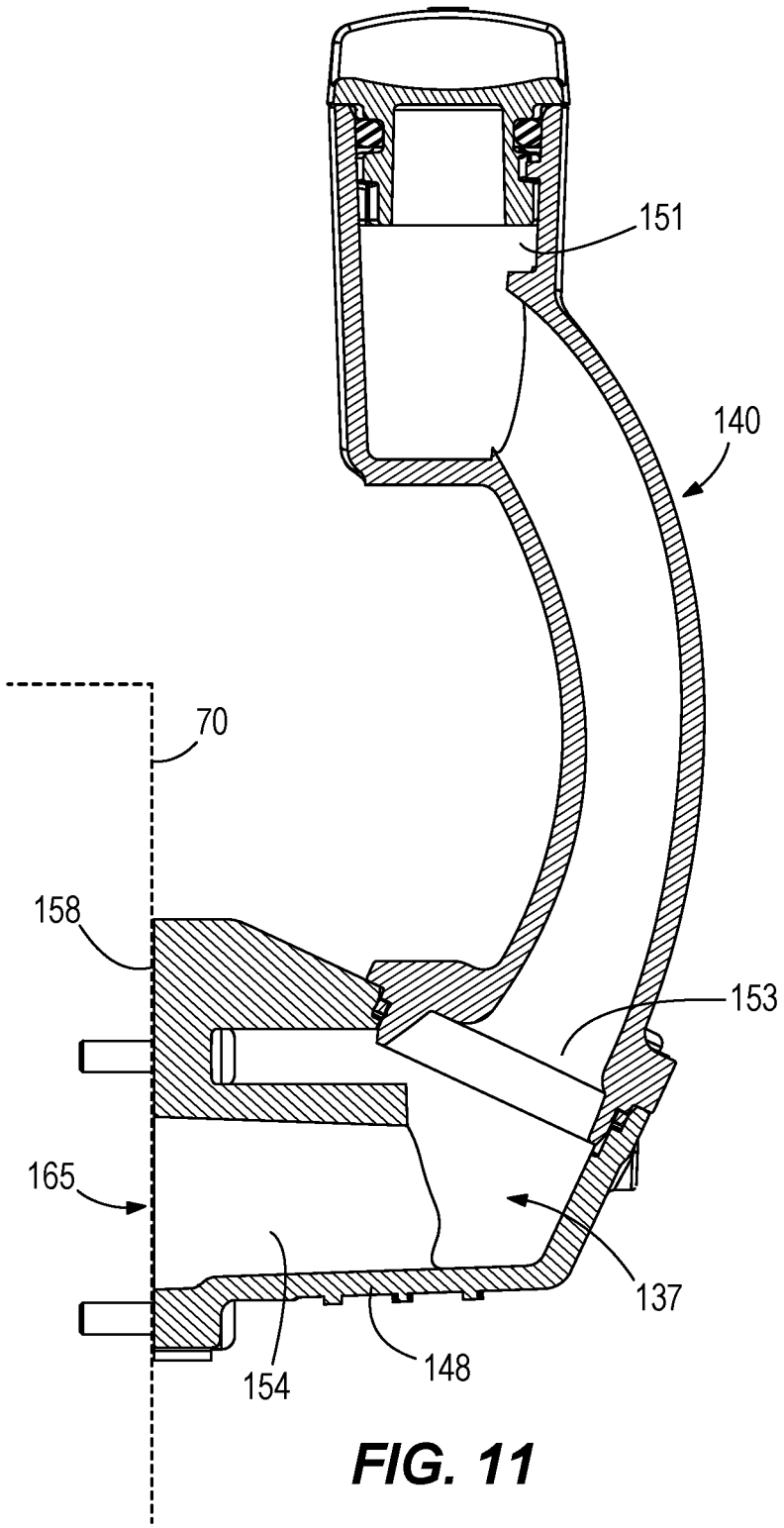
FIG. 11 is a view of section 11-11, shown in FIG. 10.

Referring now to FIGS. 9 and 10, the engine oil device 134 is in the port laterally enlarged gap portion and is specially configured to permit addition and removal of engine oil and a filter for the engine oil from above the powerhead compartment 50 while the outboard motor 20 remains in the water. The engine oil device 134 is fully described in the presently incorporated U.S. Pat. No. 10,723,427. Briefly, the engine oil device 134 has an oil fill conduit 140, which during servicing supplies engine oil directly to the crankcase 70, a replaceable oil filter 143 for filtering the engine oil, and a dipstick conduit 145 containing a dipstick 178 for checking the level of engine oil in a sump 147 (see FIG. 7) in the midsection 56 of the outboard motor 20. The sump 147 is further described in the presently incorporated U.S. patent application Ser. No. 16/938,464. An adapter 148 affixes the engine oil device 134, including the oil fill conduit 140, oil filter 143, and dipstick conduit 145 directly to the port side of the crankcase 70 (optionally it can be mounted to a bedplate of the crankcase 70), as shown in FIG. 6. The adapter 148 is a monolithic component, for example a metal casting. Location of the oil fill conduit 140 on the port side of the crankcase 70, and particularly in the peripheral gap, and even more particularly in the noted port laterally enlarged gap portion, uniquely and advantageously facilitates servicing of the engine oil from above the powerhead compartment 50.

The oil fill conduit 140 is nested in an inlet recess 137 on the adapter 148 and has an inlet end 151 for receiving the engine oil during servicing and an outlet end 153 for discharging the engine oil to a through-bore 154 in the adapter 148. A manually removable cap 139 is located on the inlet end 151. The through-bore 154 extends from a fill recess 157 that nests the oil fill conduit 140 to a low-pressure outlet 165 on the end face 158 of a mounting flange 156 which faces a port side surface of the crankcase 70. Preferably the inlet end 151 of the oil fill conduit 140 is sized and located relative to the service lid 62 to accommodate filling of engine oil via a conventional five-quart engine oil container. Optionally, seals and/or a filter for filtering particulates (not shown) can be provided between the adapter 148 and the crankcase 70. As shown, a ring seal 160 for preventing engine oil leakage is located between the outlet end 153 of the oil fill conduit 140 and the fill recess 137.

The oil filter 143 is configured to filter engine oil, as described in U.S. patent application Ser. No. 16/938,464. Briefly, the adapter 148 mounts the oil filter 143 to the port side surface of the crankcase 70. The adapter 148 has a high-pressure inlet port 162 that receives pressurized engine oil from a pump via line 159. The high-pressure inlet port 162 supplies the pressurized engine oil to the center of a replaceable filter element 167 via a center inlet 168. The replaceable filter element 167 is a conventional oil filter having a canister 170 that is engaged in nested, center-threaded (twist-on, twist-off) connection with the center inlet 168 and relative to a filter cup 171 surrounding the center inlet 168. A conventional filter media element is disposed in the canister 170 and configured to filter the engine oil as it is pumped into the center of the filter media element and then radially outwardly through the filter media and back down to an outlet in the adapter 148, between the filter cup 171 and the center inlet 168. A through-bore in the adapter 148 feeds the filtered engine oil to a high-pressure outlet 174 formed through the end face 158 of the mounting flange 156, which in turn directly supplies the filtered engine oil to the crankcase 70. The canister 170 and filter media element are easily manually serviceable from above the powerhead compartment 50 by simply twisting the canister 170 relative to the adapter 148 to separate the center-threaded connection.

As described in U.S. patent application Ser. No. 16/938,464, the engine oil device 134 is a "drip-free" configuration which permits efficient servicing without mess. During servicing, the engine oil efficiently drains via the adapter 148. Evacuation of engine oil from the sump 147 is efficiently accomplished by removing the dipstick 178 and applying a vacuum on the dipstick tube 176. Venting to accommodate engine oil fill and extraction is facilitated by opening and/or removing the twist-on, twist-off cap on the oil fill conduit 140 and by opening the canister 170, which also advantageously facilitates drainage of engine oil from the filter media to the outlet in the filter cup 171 during extraction via the dipstick tube 176, thus providing a drip-free engine oil change process. All these steps can be efficiently undertaken from above the powerhead compartment 50 while the outboard motor 20 remains in the water.

An oil pressure sensor 180 (see FIG. 4) is mounted on the adapter 148 and efficiently monitors engine oil pressure immediately downstream of the oil filter 143. A hang-bracket 182 is connected to the dipstick tube 176 on the front of the adapter 148 and is configured to retain an electrical connector wire that electrically connects the noted an electronically-actuatable latching device 64 to a power supply, as disclosed U.S. patent application Ser. No. 16/986,938. As disclosed in U.S. patent application Ser. No. 16/986,669, the cowl body 60 is removable from the midsection 56 via operation of fasteners and latches. Prior to removal, the technician must disconnect the noted electrical connector wire from the latching device 64. During servicing, the technician can place the free end of the electrical connector wire on the hang-bracket 182 to prevent it from inadvertently becoming lost, for example by falling into the midsection 56 via the noted peripheral gap.

Referring to FIGS. 3 and 4, an engine diagnostic connector device 190 is in the peripheral gap, forwardly of the starboard laterally enlarged gap portion. In the illustrated embodiment, the engine diagnostic connector device 190 is a conventional Mercury Marine Smartcraft 10-pin connector, which enables the technician to connect diagnostic computer software to the engine control unit (ECU) associated with the outboard motor 20. The engine diagnostic connector device 190 is advantageously manually accessible from above the outboard motor 20 when the service lid 62 is open or removed.

Figure 8:
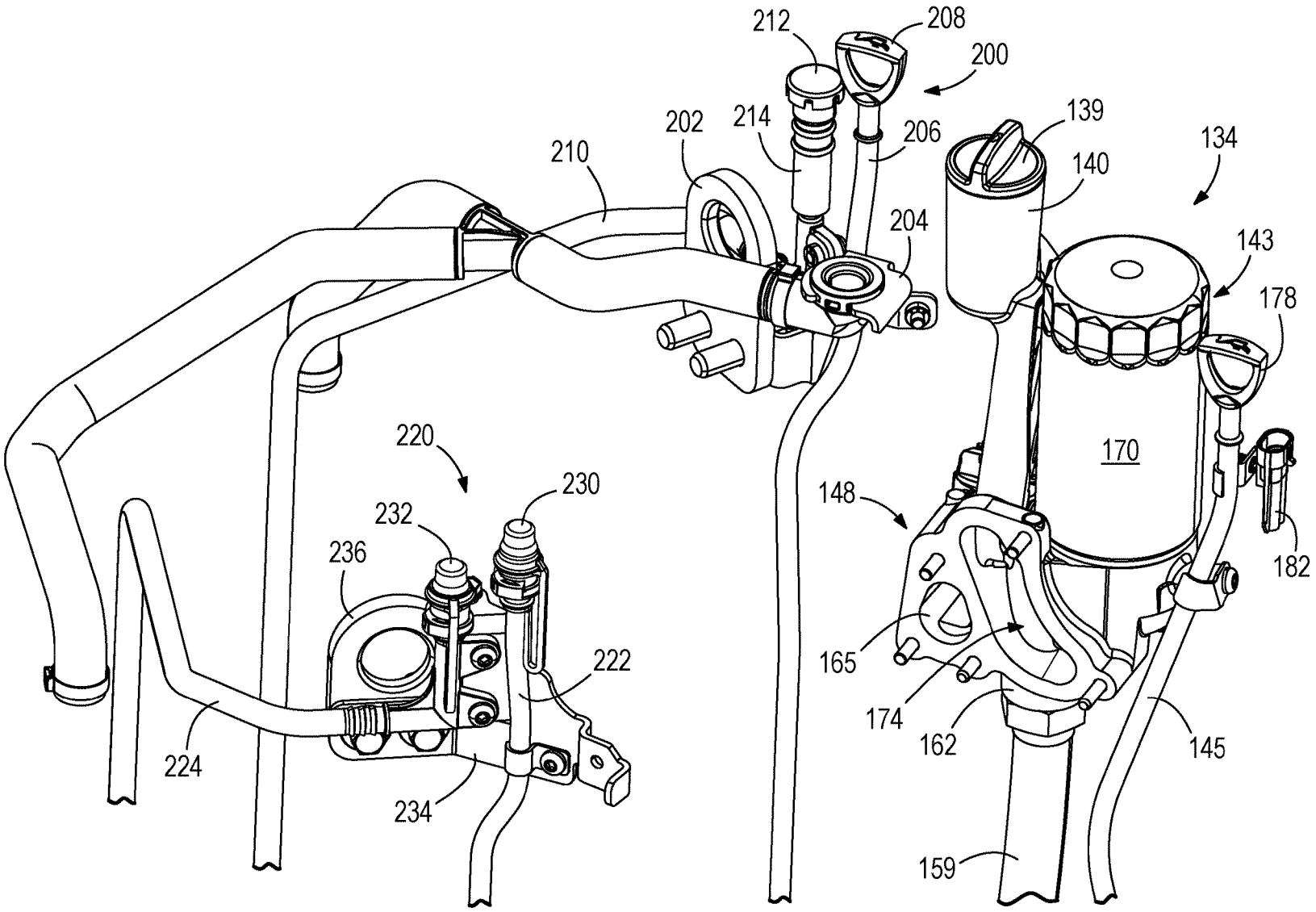
FIG. 8 are isolated perspective views of a serviceable engine oil device, transmission fluid device and gearcase fluid device.

Referring to FIGS. 7-9, a serviceable transmission fluid device 200 is located on the port side of the peripheral gap, forwardly of the laterally enlarged gap portion. The transmission fluid device 200 is advantageously manually accessible from above the outboard motor 20 when the service lid 62 is open or removed. This permits addition and/or removal of transmission fluid to and from a lubrication system for the noted transmission 74, which is further described in the presently incorporated U.S. patent application Ser. No. 16/938,464. The transmission fluid device 200 is mounted to the port-side lifting eye 202 of the powerhead 66 by a mounting bracket 204 and includes a dipstick tube 206, a dipstick 208 in the dipstick tube 206, and a vent tube 210 having a vent cap 212. The dipstick 208 is configured for checking level of transmission fluid in the lubrication system. To remove transmission fluid from the transmission 74, the technician removes the dipstick 208 from the dipstick tube 206 and opens or removes the vent cap 212 from the vent tube 210. The technician then applies suction to the dipstick tube 206 with a conventional vacuum device. To add new transmission fluid, the technician pours the fluid into the dipstick tube 206 while having the vent cap 212 open or removed from the vent tube 210. In a non-limiting example, the vent cap 212 has a sleeve 214 that is engaged in sealing relationship with the top of the vent tube 210.

Also referring to FIGS. 7-9, a serviceable gearcase fluid device 220 is located on the starboard side of the peripheral gap, forwardly of the laterally enlarged gap portion, and particularly on an opposite side of the engine 68 relative to the transmission fluid device 200. Location on the opposite side of the powerhead compartment 50 advantageously decreases the likelihood that the technician will add the incorrect type of fluid or engine oil to the serviceable gearcase fluid device 220. The serviceable gearcase fluid device 220 is manually accessible from above the outboard motor 20 when the service lid 62 is in the open position, for addition and removal of gearcase fluid to and from the gearcase 58. The serviceable gearcase fluid device 220 includes a fill conduit 222 and a vent conduit 224, each having a top 226, 228 having removable caps 230, 232. Each cap 230, 232 is a snap-on, snap-off device, and is tethered to the top 226, 228 to prevent it from becoming lost. A mounting bracket 234 mounts the fill and vent conduits 222, 224 together to the port-side lifting eye 236 of the powerhead 66.

Referring to FIG. 7, the fill and vent conduits 222, 224 extend from the powerhead compartment 50, through the pass-through plate and midsection 56 to the gearcase 58, and in particular through passages in the steering housing 146 in the midsection 56 and corresponding passages extending alongside the steering axis defined by the steering column 149. The fill and vent conduits 222, 224 are both sized and located such that filling gearcase fluid via the fill conduit 222 will first fill the gearcase 58 and then will fill the vent conduit 224 until the fluid becomes visible at the upper end of the vent conduit 224 in the powerhead compartment 50. The fill and vent conduits 222, 224 are fluidly connected to the gearcase 58 via cross-drilled passages in the steering housing passage (shown schematically at 172) that communicate to radial sealed cavities on the steering kingpin, located generally at reference character 173. The noted steering kingpin 173 has drilled passages that connect the radial sealed cavities 173 to the gearcase 58 via a bolted joint between kingpin and gearcase 58. See also U.S. Pat. No.

10,800,502. Within the gearcase 58, tubes 175 extend toward the bottom of a cavity in the gearcase 58, extending the fill conduit 222 all the way to the bottom of the cavity, to maximize amount of fluid evacuated, and extending the vent conduit 224 to a desired static fill level in the gearcase 58.

When gearcase fluid is pumped into the gearcase 58 and reaches the level of the vent conduit 224 in the gearcase 58, it will be forced up the vent conduit 224 and provide a visual indicator in the powerhead compartment 66 for the technician to determine that the gearcase 58 is full. The technician can determine whether the correct amount of gearcase fluid has been added by seeing whether the upper end of the vent conduit 224 is filled. Optionally, markings for maximum and minimum correct levels of gearcase fluid are provided on the upper end of the vent conduit 224. As such, the serviceable gearcase fluid device 220 is advantageously configured such that filling gearcase fluid via the fill conduit 222 fills the gearcase to a level that can be visually determined based on the level of gearcase fluid in the vent conduit 224. To service the gearcase fluid, the technician first removes both caps 230, 232 and then evacuates the gearcase fluid from the fill conduit 222. Then the technician fills new gearcase fluid to the fill conduit 222 until gearcase fluid fills up the upper portion of the vent conduit 224, to a level that is within the maximum and minimum markings.

As used herein, "about," "approximately," "substantially," and "significantly" will be understood by persons of ordinary skill in the art and will vary to some extent on the context in which they are used. If there are uses of these terms which are not clear to persons of ordinary skill in the art given the context in which they are used, "about" and "approximately" will mean plus or minus <10% of the particular term and "substantially" and "significantly" will mean plus or minus >10% of the particular term.

This written description uses examples to disclose the invention, including the best mode, and also to enable any person skilled in the art to make and use the invention. Certain terms have been used for brevity, clarity and understanding. No unnecessary limitations are to be inferred therefrom beyond the requirement of the prior art because such terms are used for descriptive purposes only and are intended to be broadly construed. The patentable scope of the invention is defined by the claims, and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. An outboard motor for propelling a marine vessel in a body of water, the outboard motor comprising:

a top cowl and a service lid on the top cowl;

a powerhead compartment defined within the top cowl, wherein the service lid is movable into and between a closed position enclosing the powerhead compartment and an open position providing manual access to the powerhead compartment from above the outboard motor;

an engine in the powerhead compartment, wherein a peripheral gap is defined between the top cowl and an air intake plenum on the engine;

a transmission that operatively couples the engine to a propulsor for generating a thrust force in the body of water, wherein the propulsor is supported within a gearcase located below the powerhead compartment;

a serviceable engine oil device in the peripheral gap and being manually accessible from above the outboard motor when the service lid is in the open position, for addition and removal of engine oil;

a serviceable transmission fluid device in the peripheral gap and being manually accessible from above the outboard motor when the service lid is in the open position, for addition and removal of transmission fluid; and a serviceable gearcase fluid device in the peripheral gap, the serviceable gearcase fluid device being manually accessible from above the outboard motor when the service lid is in the open position, for addition and removal of gearcase fluid to and from the gearcase.

2. The outboard motor according to claim 1, further comprising an emergency steering release device in the peripheral gap and being manually accessible from above the outboard motor when the service lid is in the open position, for manually actuating a steering system for steering a steerable gearcase of the outboard motor.

3. The outboard motor according to claim 1, further comprising an engine control unit (ECU) for controlling the engine and an engine diagnostic connector device in the peripheral gap and being manually accessible from above the outboard motor when the service lid is in the open position, for connecting a diagnostic link to the ECU.

4. The outboard motor according to claim 1, further comprising a fuse box containing electrical fuses for the outboard motor, the fuse box being in the peripheral gap and having a cover that is manually accessible from above the outboard motor when the service lid is in the open position, for replacement of the electrical fuses therein.

5. The outboard motor according to claim 4, wherein the fuse box is removably mounted to an airbox located above the engine.

6. The outboard motor according to claim 1, further comprising an alternator belt for the engine, the alternator belt being located above the engine and below the air intake plenum, the alternator belt being manually accessible from above the outboard motor when the service lid is in the open position and the air intake plenum is removed, facilitating replacement of the alternator belt from above the outboard motor.

7. The outboard motor according to claim 1, further comprising:

an emergency steering release device in the peripheral gap and being manually accessible from above the outboard motor when the service lid is in the open position, for manually actuating a steering system associated with a steerable gearcase of the outboard motor;

an engine control unit (ECU) for controlling the engine and an engine diagnostic connector device in the peripheral gap and being manually accessible from above the outboard motor when the service lid is in the open position, for connecting a diagnostic link to the ECU;

a fuse box containing electrical fuses for the outboard motor, the fuse box being in the peripheral gap and having a removable cover that is manually accessible from above the outboard motor when the service lid is in the open position, for replacement of the electrical fuses therein; and an alternator belt for the engine, the alternator belt being located above the engine and below the air intake plenum, the alternator belt being manually accessible from above the outboard motor when the service lid is in the open position and the air intake plenum is removed, facilitating replacement of the alternator belt from above the outboard motor.

8. The outboard motor according to claim 1, wherein the serviceable transmission fluid device comprises a fill tube and a vent tube that are together mounted to the engine.

9. The outboard motor according to claim 8, wherein the serviceable transmission fluid device further comprises a dipstick in the fill tube for checking level of transmission fluid associated with a transmission of the outboard motor.

10. An outboard motor for propelling a marine vessel in a body of water, the outboard motor comprising:

a top cowl and a service lid on the top cowl;

a powerhead compartment defined within the top cowl, wherein the service lid is movable into and between a closed position enclosing the powerhead compartment and an open position providing manual access to the powerhead compartment from above the outboard motor;

an engine in the powerhead compartment, the engine having a crankcase containing a crankshaft;

a serviceable engine oil device being manually accessible from above the outboard motor when the service lid is in the open position, for addition and removal of engine oil, wherein the serviceable engine oil device has an oil fill conduit which during servicing supplies engine oil directly to the crankcase.

11. The outboard motor according to claim 10, wherein the oil fill conduit has an inlet end for receiving the engine oil during servicing and an opposite, outlet end that discharges the engine oil to the crankcase.

12. The outboard motor according to claim 10, wherein the oil fill conduit discharges the engine oil directly to the crankcase via an adapter plate.

13. The outboard motor according to claim 10, wherein the serviceable engine oil device further comprises an adapter that mounts the engine oil device to the crankcase.

14. The outboard motor according to claim 13, wherein the adapter comprises a through-bore that discharges the engine oil from the outlet end of the oil fill conduit to a bore in a sidewall of the crankcase or a bedplate on the crankcase.

15. The outboard motor according to claim 13, wherein the engine oil device further comprises a replaceable filter that filters the engine oil, the replaceable filter being manually accessible from above the outboard motor when the service lid is in the open position.

16. The outboard motor according to claim 15, wherein the replaceable filter is coupled to the adapter and wherein the adapter has an inlet for receiving engine oil for filtering in the replaceable filter and an outlet for discharging the engine oil after filtering in the replaceable filter.

17. The outboard motor according to claim 16, wherein the adapter is a monolithic component.

18. The outboard motor according to claim 16, wherein the engine oil device further comprises a dipstick tube and dipstick therein for checking engine oil level in an engine oil sump containing the engine oil and for venting the engine oil sump when engine oil is added to the engine via the oil fill conduit; wherein the dipstick tube is mounted to the engine via the adapter.

19. An outboard motor for propelling a marine vessel in a body of water, the outboard motor comprising:

a top cowl and a service lid on the top cowl;

a powerhead compartment defined within the top cowl, wherein the service lid is movable into and between a closed position enclosing the powerhead compartment and an open position providing manual access to the powerhead compartment from above the outboard motor;

an engine in the powerhead compartment, the engine having a crankcase containing a crankshaft; and a serviceable gearcase fluid device being manually accessible from above the outboard motor when the service lid is in the open position, for addition and removal of gearcase fluid to and from a gearcase of the outboard motor, wherein the serviceable gearcase fluid device comprises a fill conduit and a vent conduit, and wherein the fill conduit and the vent conduit are configured such that filling gearcase fluid to the gearcase via the fill conduit fills the gearcase to a level that can be visually determined based on gearcase fluid in the vent conduit.

20. An outboard motor for propelling a marine vessel in a body of water, the outboard motor comprising:

a top cowl and a service lid on the top cowl;

a powerhead compartment defined within the top cowl, wherein the service lid is movable into and between a closed position enclosing the powerhead compartment and an open position providing manual access to the powerhead compartment from above the outboard motor;

an engine in the powerhead compartment, the engine having a crankcase containing a crankshaft; and an emergency steering release device being manually accessible from above the outboard motor when the service lid is in the open position, for manually actuating a steerable gearcase of the outboard motor, wherein the emergency steering release device comprises a linkage that is operable to disconnect a hydraulic steering apparatus so the steerable gearcase can be steered.

21. An outboard motor for propelling a marine vessel in a body of water, the outboard motor comprising:

a top cowl and a service lid on the top cowl;

a powerhead compartment defined within the top cowl, wherein the service lid is movable into and between a closed position enclosing the powerhead compartment and an open position providing manual access to the powerhead compartment from above the outboard motor;

an engine in the powerhead compartment, wherein a peripheral gap is defined between the top cowl and an air intake plenum on the engine;

a transmission that operatively couples the engine to a propulsor for generating a thrust force in the body of water, wherein the propulsor is supported within a gearcase located below the powerhead compartment;

a serviceable engine oil device in the peripheral gap and being manually accessible from above the outboard motor when the service lid is in the open position, for addition and removal of engine oil;

a serviceable transmission fluid device in the peripheral gap and being manually accessible from above the outboard motor when the service lid is in the open position, for addition and removal of transmission fluid; and a serviceable gearcase fluid device in the peripheral gap and on an opposite side of the engine relative to the serviceable transmission fluid device, the serviceable gearcase fluid device being manually accessible from above the outboard motor when the service lid is in the open position, for addition and removal of gearcase fluid to and from the gearcase.

* * * * *